United States Patent [19]

Shepherd et al.

[11] 4,388,289

[45] Jun. 14, 1983

[54] METHOD OF REMOVING ALKALI AND ALKALINE EARTH METAL IMPURITIES FROM OXIDIZED PAN MATERIAL

[75] Inventors: Gary D. Shepherd, Redondo Beach; Ramon B. Fernandez, Hawthorne; Ian R. Rule, Encino, all of Calif.

[73] Assignee: Hitco, Irvine, Calif.

[21] Appl. No.: 140,257

[22] Filed: Apr. 14, 1980

Related U.S. Application Data

[63] Continuation-in-part of Ser. No. 53,756, Jul. 2, 1979, abandoned, which is a continuation of Ser. No. 800,784, May 26, 1977, abandoned.

[51] Int. Cl.[3] ..... D01F 9/22

[52] U.S. Cl. ..... 423/447.4; 8/115.5; 264/29.2; 423/447.2; 423/447.6

[58] Field of Search ..... 423/447.1, 447.2, 447.4, 423/447.6; 8/115.5, 137, 137.5, 138, 139; 264/29.2; 252/100, 134, 142

[56] References Cited

U.S. PATENT DOCUMENTS

| | | | |
|---|---|---|---|
| 2,932,550 | 4/1960 | Walmsley | 8/115.5 X |
| 3,179,605 | 4/1965 | Ohsol | 423/447.4 |
| 3,412,062 | 11/1968 | Johnson et al. | 423/447.6 X |
| 3,413,094 | 11/1968 | Gibson | 423/447.2 |
| 3,532,466 | 10/1970 | Johnson et al. | 423/447.6 |
| 4,070,446 | 1/1978 | Horikiri et al. | 264/29.2 X |
| 4,073,869 | 2/1978 | Kalnin | 423/447.1 |
| 4,113,847 | 9/1978 | Fukushima et al. | 423/447.6 X |

FOREIGN PATENT DOCUMENTS

| | | | |
|---|---|---|---|
| 48-42812 | 12/1973 | Japan | 423/447.2 |
| 49-26195 | 3/1974 | Japan | 8/115.5 |
| 49-109633 | 10/1974 | Japan | 264/29.2 |
| 1458571 | 1/1974 | United Kingdom . | |

OTHER PUBLICATIONS

Takahashi, "Chemical Abstracts", vol. 64, 1966, 8367b-c, 12,862b-c.

*Primary Examiner*—Edward J. Meros
*Attorney, Agent, or Firm*—Fraser and Bogucki

[57] ABSTRACT

Fibrous PAN material in raw or oxidized form is purified of alkali metals, particularly sodium, and alkaline earth metals by treating with an aqueous acid solution such as hydrochloric acid having a concentration of at least 0.5% by weight and preferably at least 3% and a temperature greater than 100° F. and preferably at least 125° F. but not greater than the temperature at which the aqueous acid solution boils, for 5–120 minutes and preferably at least about 15 minutes. An ion exchange occurs between the acid and the PAN material, and alkali and alkaline earth metal salts are formed. The PAN material is then rinsed in solvent such as deionized water which is substantially free of metallic ions at a temperature which is preferably at least about 150° F. but not greater than the temperature at which the solvent boils for 5–30 minutes to remove the formed salts, following which the material is dried and may thereafter be carbonized to produce a carbon product which is very low in alkali and alkaline earth metal content while at the same time relatively low in thermal conductivity. Methods in accordance with the invention are preferably implemented as a continuous process, and have been found to reduce the total alkali and alkaline earth metal content in commercially available oxidized PAN material to less than 13 ppm prior to carbonization in well under an hour of processing.

10 Claims, No Drawings

METHOD OF REMOVING ALKALI AND ALKALINE EARTH METAL IMPURITIES FROM OXIDIZED PAN MATERIAL

CROSS-REFERENCE TO RELATED APPLICATIONS

This application is a continuation-in-part of application Ser. No. 53,756, METHOD OF REMOVING ALKALI AND ALKALINE EARTH METAL IMPURITIES FROM CARBONACEOUS MATERIAL, filed July 2, 1979 now abandoned by Gary D. Shepherd, Ramon B. Fernandez and Ian R. Rule and commonly assigned with this application. Application Ser. No. 53,756 is a continuation of application Ser. No. 800,784, METHOD OF REMOVING ALKALI AND ALKALINE EARTH METAL IMPURITIES FROM CARBONACEOUTS MATERIAL, filed May 26, 1977 now abandoned by Gary D. Shepherd, Ramon B. Fernandez and Ian R. Rule and commonly assigned with this application.

BACKGROUND OF THE INVENTION

1. Field of the Invention

The present invention relates to methods of removing impurities from carbonaceous materials, and more particularly to methods of removing sodium, potassium and other alkali metals and alkaline earth metals from PAN materials.

2. History of the Prior Art

It is known in the art to provide products made from carbonaceous material in various forms such as fibers which have been woven into a fabric and carbonized. For certain applications such as ablative components on aerospace vehicles and the like, such products in addition to being carbonized should have relatively low thermal conductivity to minimize heat transfer to adjacent components as well as relatively small amounts of alkali and alkaline earth metals particularly sodium, to prevent ionization at levels which can be tracked by radar. For such applications alkali and alkaline earth metals must be considered impurities, and as such are desirably removed from the carbonaceous material as completely as possible.

There are various ways of producing carbonaceous materials having the desirable low content of alkali and alkaline earth metal impurities. One way is to heat the material within the graphitization temperature range. This has proven to be undesirable in that while it volatilizes and thereby eliminates most or all of the alkali impurities, it also leaves the material with a crystalline structure of a graphitic nature such that the thermal conductivity thereof is unacceptably high. Another approach is to make the carbonaceous product from precursor material which itself has a very low alkali and alkaline earth metal content. However, such precursor materials are very expensive to produce and are not found among standard commercially available materials. A third approach, which is the one most often used for economical reasons, is to treat the carbonaceous material at some stage in the processing thereof prior to carbonization to remove a substantial portion of the alkali and alkaline earth metal impurities. This enables the material to be subsequently carbonized at low enough temperatures so as not to adversely affect the crystalline structure and thereby the thermal conductivity of the final product while at the same time providing a relatively pure product of substantial carbon composition.

U.S. Pat. No. 3,413,049 of Gibson, issued Nov. 26, 1968 and assigned to the assignee of this application, provides one example of a method of treating fibrous carbonaceous materials so as to eliminate alkali and alkaline earth metal impurities. The methods of the Gibson patent involve dipping material which has been carbonized in an aqueous solution of hydrobromic acid or hydroiodic acid and thereafter firing the treated products at a temperature sufficient to remove substantial metallic impurities but below a temperaature sufficient to substantially increase thermal conductivity and crystallinity of the product. Following the acid dip, the material is full of alkali and alkaline earth metal impurities, and the extra firing step is required in order to eliminate such impurities. However, the extra firing step increases the chance of crystallization of the material and resulting higher thermal conductivity in the finished product.

The methods of the Gibson patent were developed in conjunction with the widespread use of cellulosic precursor materials such as rayon, and such methods are unsatisfactory when used with materials of polyacrylonitrile origin. This appears to be due in part to the distribution and chemical bonding of alkali and alkaline earth metal ions throughout the thickness of the fibers in the case of polyacrylonitrile material. Such impurities in materials of cellulosic origin are not an intrinsic chemical part of the fiber and at the same time are concentrated at or adjacent the fiber surface and therefore relatively easily removed by various washing and scrubbing techniques.

The availability of polyacrylonitrile precursor materials in recent years and the resulting popularity thereof in terms of low cost and other factors have created a need for a method of purification capable of reducing the total alkali and alkaline earth metal content of carbonized material to levels on the order of 30 parts per million or less.

It is generally known that certain types of carbonaceous materials can be purified to some extent by washing in acids, detergents, or even pure water. An example of a treatment involving washing with both detergent and acid is provided by U.S. Pat. No. 3,179,605 of Ohsol, issued Apr. 20, 1965. The Ohsol patent is concerned with purification of regenerated cellulosic fibers for purposes of enhancing their general properties such as tensile strength rather than alkali and alkaline earth metal purity. This is done by washing the fibers in a non-ionic detergent, then rinsing in water, then washing in an aqueous acid solution, then rinsing in water, then drying, and finally carbonizing the fibers.

The Ohsol patent is typical of prior art methods of treatment which are complex and which do not produce acceptable levels of final purity for ablative applications even when used to purify materials of cellulosic origin. When such methods are used to process carbonaceous material of other than cellulosic origin such as materials made from polyacrylonitrile precursors, the resultant laundering of some surface impurities and little else has little effect on the total impurity content. While the patent discusses purity levels on the order of 10–25 parts per million of sodium in conjunction with its cellulosic precursor material, the total alkali and alkaline earth metals content is much larger and becomes even higher as the material is carbonized.

U.S. Pat. No. 2,950,253 of Kling et al provides a further example of a washing or laundering process for removing surface impurities. Kling et al disclose a variety of different chemicals for cleaning soiled fabric.

U.S. Pat. No. 4,079,446 of Horikiri et al which is of interest with respect to acid treatment of materials addresses the problem of the instability of polyethylene at high temperatures. Polyethylene is very difficult to form into a fiber and readily loses fiber integrity upon heating. In order to overcome this obstacle in forming a carbon fiber out of polyethylene fiber, the polyethylene is treated with an acid to preserve fiber integrity. The acid is such that it sulfonates the fiber. Accordingly, Horikiri et al do not deal with the removal of alkali and alkaline earth metals from fibers such as polyacrylonitrile but instead address the specific problem of the poor integrity of polyethylene fibers at high temperatures and the fact that such integrity can be improved by sulfonating the fiber through interaction with an acid.

A further patent which is of interest with respect to acid treatment of materials is U.S. Pat. No. 4,113,847 of Fukushima et al. The Fukushima et al patent relates to a process for making acrylonitrile precursor material in which a spun mixture of fibers including acrylonitrile is washed and then stretched in hot acid water having a pH below a specified level. Thus this patent relates to the production of PAN precursor having good filament separability, no breakage of single filaments and few fluffs and little disorder of filaments, and not to the purification of PAN material which has already been produced.

U.S. Pat. No. 2,932,550 of Walmsley is of interest for its disclosure of the treatment of PAN material with an acid. However, such treatment has nothing to do with purification and instead is performed to create dye sites. Thereafter, a dye chemically combines with the PAN material, which is the desired result. The PAN material is immersed in sodium carbonate, reinforcing the fact that Walmsley is not concerned with the presence of sodium or other alkali or alkaline earth metals.

U.S. Pat. No. 3,412,062 of Johnson et al and U.S. Pat. No. 3,532,466 of Johnson et al are of interest in describing conventional processes for carbonizing polyacrylonitrile material.

Accordingly it would be advantageous to provide a method capable of reducing the alkali and alkaline earth metal impurities in PAN materials to significantly low levels.

It would furthermore be advantageous to provide a method of reasonable simplicity and economy while at the same time capable of producing very low levels of alkali and alkaline earth metal impurities on the order of those presently desired or required for ablative and other aerospace applications of PAN materials.

BRIEF SUMMARY OF THE INVENTION

The present invention is based on the observation that in the case of polyacrylonitrile materials, alkali and alkaline earth metals are introduced during the forming polymerization and become an intrinsic chemical part of the polymer. Methods in accordance with the invention treat such material with acid to form salts from the alkali and alkaline earth metal impurities through ion exchange. The salts are removed by rinsing with a solution such as deionized water which is substantially free of alkali and alkaline earth metal impurities, following which the material may be dried and then carbonized. The method is preferably implementated as a continuous process in which the acid forming a part of an aqueous acid solution and the deionized rinse water are heated to temperatures above room temperature and the aqueous acid solution has at least a nominal concentration. The resulting continuous process has been found to purify oxidized PAN material quickly enough to make it very attractive commercially.

The concentration of the aqueous acid solution may vary from as little as 0.5% by weight to as much as 35% by weight or more, depending on the acid used, the temperature thereof and the residence time for the acid. In most instances relatively low concentrations on the order of 3–5% are successfully used by treating the carbonaceous material long enough and at a high enough temperature. A temperature range of about 125° F. up to the temperature at which the aqueous acid solution boils is preferably used in conjunction with a residence time of at least 5 minutes, as long as 120 minutes and preferably on the order of at least about 30 minutes.

Following treatment of the carbonaceous material in aqueous acid, material is rinsed in deionized water or other solvent which is relatively free of alkali and alkaline earth metal ions and in which the acid and salts thereof are soluble. The rinsing operation is carried out at a high enough temperature and for a long enough period of time so as to dissolve and wash away substantially all residual acid and the acid salts formed by the ion exchange during treatment with the aqueous acid solution. Good results are achieved if the rinsing operation is carried out for 5–30 minutes, and particularly if in addition the solvent is heated to a temperature within a range from 150° F. up to the temperature at which the solvent boils. The rinsing step has been found to be an extremely important one, and is generally enhanced by processing equipment which sprays the carbonaceous material with the solvent in addition to bathing the material in the solvent.

Following rinsing, the material is next dried to remove all or substantially all of the residual solvent therefrom. The material may then be carbonized by heating in a non-oxidizing atmosphere to a temperature range on the order of 1500° F. up to a temperature at which the material begins to graphitize. Temperatures within such range are high enough to produce substantially complete carbonization without having any undesirable effect on the thermal conductivity thereof.

DETAILED DESCRIPTION

Methods in accordance with the invention purify polyacrylonitrile material of alkali and alkaline earth metals. The material which is in an uncarbonized from is treated in an aqueous acid solution at a desired concentration for a selected period of time at an elevated temperature, within a desired range, preferably accompanied by motion between the aqueous acid and the material. The treated material is then rinsed in a solvent substantially free of metallic ions, at an elevated temperature within a desired range and for a selected period of time. The material is then dried, following which it may be further processed including eventual carbonization. PAN based materials made in accordance with this method exhibit the requisite properties of low alkali and alkaline earth metal content and low thermal conductivity. At the same time other properties such as tensile strength have been found not to be degraded or generally affected by the purification processing.

While methods in accordance with the invention are applicable to carbonaceous materials in various forms, they are ideally suited for use with material in fibrous form including raw fibers made from precursor materials as well as fabrics made by oxidizing the raw fibers, spinning the fibers into yarns and weaving the yarns into fabric. Carbonaceous products for ablative and similar uses in aerospace and other applications are typically prepared in this form.

As will be noted from the examples hereafter, purification treatments in accordance with the invention may be performed on carbonaceous material of polyacrylonitrile origin at various stages in its processing including the raw fiber stage and after the fibers have been oxidized to at least some extent. As between raw fibers and oxidized fibers, purification of the fibers after at least some oxidization is preferred in most instances because the degree of purification tends to be greater than in cases where the raw fibers are purified. This is probably due to several factors including the tendency to contaminate raw fibers when oxidizing them, processing them to form a yarn, and then knitting or weaving into a fabric. In addition, penetration of the fibers by the aqueous acid solution is more complete after oxidation due to the resultant change in the nature of the fibers from hydrophobic to hydrophilic caused by the oxidation.

The term "oxidized" is used herein in accordance with its well known meaning in the art to describe polyacrylonitrile material which has been subjected to any of the various processes which can be used to effect the substantial stabilization of the material such that substantially complete cyclization of the nitrile material occurs. A common example of such a process is to heat the material in air to a temperature in the range of 220°–260° C.

Methods in accordance with the invention have particular interest in and application to polyacrylonitrile materials because of the introduction of relatively large amounts of alkali and alkaline earth metals such as sodium and potassium during polymerization of acrylonitrile to form polyacrylonitrile. The resulting sodium and/or potassium in the polyacrylonitrile is therefore put there intentionally and constitutes an impurity only in the sense that it must be removed for certain applications of the fibrous material such as to prevent radar tracking when used to fabricate the nose cones of space vehicles and the like. In any event the alkali and alkaline earth metals are chemically linked with and form a part of the polyacrylonitrile material and are not simply surface impurities.

Acrylonitrile has the formulation:

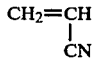

Polyacrylonitrile has the formulation:

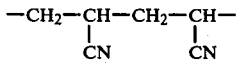

Polyacrylonitrile is typically produced from acrylonitrile by combining materials such as $NaHSO_3$ and $K_2S_2O_8$ to get $HSO_3$. and $SO_4^-$. which provide the needed free radical initiation. As a result, sodium or potassium typically is present at one or both ends of the polyacrylonitrile chain, as exemplified by the following formula:

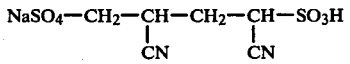

In addition to the alkali and alkaline earth metals commonly residing at the ends of the polyacrylonitrile chain, it is common for many manufacturers of polyacrylonitrile to create dye sites at various locations along the polymer chain to facilitate dying of polyacrylonitrile fibers. The dye sites may contain alkali or alkaline earth metal ions. A typical polyacrylonitrile formulation showing such a dye site is as follows:

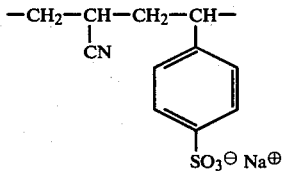

The amount of sodium in the dye site shown above is substantially greater than the amounts of sodium or potassium typically present at the ends of the copolymer chain and account for the extreme difficulty in purifying polyacrylonitrile using conventional techniques.

In accordance with the invention the unwanted sodium, potassium or other alkali and alkaline earth metal ions at the dye sites and at the ends of the copolymer chain of polyacrylonitrile are removed by chemical interaction in the form of ion exchange with an acid. For example, if hydrochloric acid (HCl) is used, then the hydrogen from the acid replaces the sodium or potassium which combines with the chloride of the acid to form salt (NaCl). Thus, a dye site having the formulation:

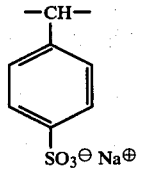

responds to the ion exchange with HCl so as to have the formulation:

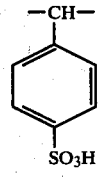

with NaCl being left over.

Because the alkali and alkaline earth metal ions permeate the entire thickness of the fibers rather than simply residing at the surface as in the case of an ordinary impurity, it is necessary for the acid solution to penetrate all or substantially all of the fiber thickness if substantial removal of such ions is to be achieved. However, the nature of such fibers is such that they do not readily wet and therefore resist penetration by the acid solution to the inner core to a substantially greater extent than penetration of the surface thereof. Thus, at room temperature the acid solution barely penetrates the fiber surface and only a very small amount of purification takes place. However if the fibers are immersed in the acid solution of great enough concentration for at least about 5 minutes with the acid solution being heated to at least about 125° F., the solution apparently penetrates the fibers to such an extent as to be able to substantially purify the fibers. By the same token the rinsing solvent is desirably maintained at a temperature above room temperature and must be present long enough to penetrate the fibers to remove the salts formed by the ion exchange of the acid with the alkali and alkaline earth metal ions.

The ion exchange step of the invention is carried out by contacting the fibers with the aqueous acid solution, such as by placing the acid solution in a container and immersing the fibers in the acid solution. Virtually any acid can be used so long as it forms alkali and alkaline earth metal salts which are soluble so that they can be dissolved and removed during the rinse operation. Examples of acids which have been successfully used in accordance with the invention include hydrochloric acid, sulfuric acid, hydrobromic acid and formic acid. Of the four acids, hydrochloric acid, sulfuric acid and perhaps hydrobromic acid, are preferred because they are inexpensive, are soluble in and form salts which are readily soluble in various solvents such as deionized water.

The aqueous acid solution preferably has a concentration of at least about 0.5% by weight and as much as 35% by weight or more depending on the acid. Hydrochloric acid can be used in concentrations up to 35% by weight. Sulfuric acid can be used at greater concentrations, although care must be taken not to degrade the fibers or damage the processing equipment. For most applications concentrations of at least 3% up to about 15% are satisfactory.

As shown by data set forth hereafter, purity varies generally directly with acid solution concentration within a usable range when all other parameters are held constant. At relatively high concentrations improvement in the purity may cease and the purity may actually get worse, probably due to the extremely high concentration of ions and the resultant inability of many of them to interact with the chemical structure of the carbonaceous material. At the other extreme low concentrations such as less than 3% in the case of hydrochloric acid may require excessive residence times, even in the presence of relatively high temperatures, so as to render the process commercially impractical.

The aqueous acid solution is preferably maintained at a temperature in the range starting above 100° F. and preferably at least 125° F. to the temperature at which the acid solution boils. It is recognized in accordance with the invention that acid temperatures within this range give significantly improved results when compared with lower temperatures. For example, a temperature range of 125°–200° F. has proven to be particularly successful when the acid is hydrochloric acid having a concentration in the 3–15% by weight range and the residence time of the fibers in the acid is on the order of 15–35 minutes. Acid temperatures as low as room temperatures will produce acceptable results in some instances, but usually only at the expense of a residence time which is so long as to make the process impractical.

The acid concentration, acid temperature and residence time are dependent upon each other. Increased acid temperatures tend to provide improved levels of purity for a given acid concentration and residence time. An optimum range of concentrations exists for each acid such that either higher or lower concentrations produce slower reaction rates. Concentrations which are too low do not produce sufficient hydrogen ions for adequate contact with the metallic ions of the fibers. Concentrations which are too high can result in crowding of ions and therefore a reduction in the combination of hydrogen ions, as previously noted.

The purification of the fibers also appears to be enhanced by treating the fibers in such a way that there is at least occasional and preferably generally continuous motion of the aqueous acid solution over the surfaces of the fibers. This can be accomplished by using a standard processing tank of the type in which the contents of the tank are removed, heated in a heat exchanger, and then returned to the tank. The continuous circulation of aqueous acid solution when stored in such a tank causes the acid solution to continually flow over the surfaces of the fibers, producing the desired relative motion. Such motion may be further enhanced by moving the fibers through the tank in the form of a woven fabric drawn from a roll and alternating between opposite rollers at the top and bottom of the tank. By driving the rollers so as to advance the fabric in various passes through the tank at a relatively slow, constant speed in well-known fashion, every part of the fabric is disposed within the aqueous acid solution for the desired residence time.

Although any solvent which is substantially free of alkali and alkaline earth metal ions and in which the acid and its salts are soluble can be used in the rinse process, ion free water such as deionized water or distilled water has proven to provide satisfactory results and is usually far less expensive than other solvents. The rinse operation has been found to be an extremely important part of methods according to the invention, probably because the fibers are not truly free of impurities until the salts formed by the ion exchange between the acid and the alkali and alkaline earth metals are dissolved in and removed by the solvent together with residual acid. The solvent has been found to work well when applied with a residence time of at least about 5 minutes and preferably within a range of 5–30 minutes which provides a reasonable compromise between purity and economy. At the same time the solvent is preferably maintained at an elevated temperature within the range from 150° F. up to the temperature at which the solvent boils (212° F. for deionized water). The temperature and time are at least somewhat dependent upon each other in that shorter residence times may suffice where higher solvent temperatures are used, and vice versa.

As used herein to describe the solvent, the expression "substantially free of alkali and alkaline earth metal ions" denotes an ion purity level which is at the very least greater than the ion purity level which the fibers are to have before carbonization. Accordingly, if the fibers are to have a total alkali and alkaline earth metals content on the order of 15 parts per million in the uncarbonized form, the solvent must have a total alkali and alkaline earth metals content of less than 15 parts per million. As a practical matter the solvent should have a total alkali and alkaline earth metals content of less than 10 parts per million and more on the order of 3 parts per million or less which is the typical range for deionized water.

During the rinse operation, it has also been found desirable to create some motion between the heated solvent and the fibers such as by spraying the fibers with the solvent at one or more locations. Where the fibers in woven fabric form are run through an acid tank as previously described, the fabric is preferably drawn from the acid tank past a station where fresh solvent is sprayed on the fabric and into a second tank where the rest of the rinsing operation is performed by spraying with an immersion in the solvent.

Following rinsing of the fibers, the fibers are next dried so as to remove substantially all of the residual solvent therefrom prior to further processing of the fibers and eventual carbonization. Where time permits, the fibers may be dried simply by exposing them to room temperature. In most instances, however, use of conventional apparatus to enhance the drying operation is preferred. For example, steam cans can be used, or in the alternative a hot air convective dryer can be used.

Following drying, fibers of polyacrylonitrile origin which have already been oxidized can be carbonized. Raw fibers of polyacrylonitrile origin which have been washed, rinsed and dried in accordance with the process described above are typically subjected to further processing prior to carbonization such as by oxidizing, then spinning into yarn, and then weaving into a fabric. Carbonization can follow any conventional form so long as it does not involve temperatures within the graphitization range which may alter the crystalline structure of the fibers in a manner so as to increase their thermal conductivity. Carbonization may be accomplished by heating the fibers to a temperature within a range of 1500° F. up to a temperature at which the material begins to graphitize in a non-oxidizing or inert atmosphere such as a nitrogen atmosphere. This may be accomplished in an appropriate conventional furnace, and may consist of insertion of the fibers into the furnace at an appropriate temperature below the temperature at which the material begins to graphitize for several minutes. Alternatively, the fibers can be heated in the furnace to increasing temperatures within this range gradually and over a substantial period of time so as to achieve other goals in the processing of the fibers and the final properties thereof.

EXAMPLE 1

To determine what effect a simple washing in water would have on raw PAN material, two different samples were washed in deionized water for two hours and were then compared with washed samples of the same material. The samples were taken from Monsanto MON-B16 and DuPont DUP-T43. The results given in parts per million are as follows:

| | Na | K | Ca | Total |
|---|---|---|---|---|
| Unwashed MON-B16 | 788 | 41 | 12 | 841 |
| Washed MON-B16 | 375 | 43 | 18 | 436 |
| Unwashed DUP-T43 | 6375 | 407 | 10 | 6792 |
| Washed DUP-T43 | 4337 | 307 | 17 | 4661 |

It will be seen that even in the case of the Monsanto MON-B16 which is relatively pure in an unwashed state, simple water washing did not even begin to produce acceptable levels of purification.

EXAMPLE 2

A sample of raw Monsanto MON-B16 material was treated in an aqueous solution of hydrochloric acid having a concentration of 35% by weight and a temperature of 203° F. for 30 minutes, following which the sample was rinsed in deionized water at 194° F. for approximately 10 minutes, then dried. The total alkali and alkaline earth metal content of the sample was found to be 35 PPM.

Next, a further sample of the raw fibers was treated with an aqueous hydrochloric acid solution having a concentration of 1.5% by weight and a temperature of 203° F. for 10 minutes, following which the sample was rinsed in deionized water at 194° F. for approximately 10 minutes, then dried. The total alkali and alkaline earth metal content was found to be 31 PPM.

Next, a further sample of the raw fibers was treated in an aqueous hydrochloric acid solution having a concentration of 3.5% by weight for 3 minutes at room temperature, following which the sample was rinsed in water at room temperature for approximately 10 minutes, then dried. The sample was determined to have a total alkali and alkaline earth metal content of 215 PPM.

A further sample of the raw fibers was treated in an aqueous sulfuric acid solution having a concentration of 2.0% by weight and a temperature of 176° F. for 5 minutes, following which the sample was rinsed in water at 194° F. for approximately 10 minutes, then dried. The sample was determined to have a total alkali and alkaline earth metal content of 66 PPM.

A further sample of the MON-B16 raw fibers was treated in an aqueous sulfuric acid solution having a 2.0% by weight concentration and a temperature of 176° F. for 5 minutes, following which the sample was rinsed in deionized water at room temperature for approximately 10 minutes, then dried. The sample as so treated was determined to have a total alkali and alkaline earth metal content of 275 PPM.

While conditions are not equal in all cases, the above data and the data set forth hereafter show some general trends and tendencies. Thus, material treated in acid is much purer than material merely washed in water. Also, acid concentrations of a few percent seem to be adequate when a reasonably long residence time is used. The levels of purity deteriorate greatly when the aqueous acid solution and rinse water are at room temperature.

EXAMPLE 3

A sample of DuPont DUP-T43 fibers was treated in an aqueous hydrochloric acid solution having a concentration of 35% by weight and a temperature of 194° F. for 30 minutes, following which the sample was rinsed in deionized water at 194° F. for approximately 10 minutes, and dried. The sample as so treated was determined to have a total alkali and alkaline earth metal content of 96 PPM.

A further sample of fibers was treated in an aqueous hydrochloric acid solution having a concentration of 1.5% by weight and a temperature of 203° F. for 10 minutes, following which the sample was rinsed in deionized water at 194° F. for approximately 10 minutes, and dried. The sample as so treated was determined to have a total alkali and alkaline earth metal content of 78 PPM.

A further sample of the fibers was treated in an aqueous hydrochloric acid solution having a concentration of 3.5% by weight for 3 minutes at room temperature, then rinsed and dried. The sample as so treated was determined to have a total alkali and alkaline earth metal content of 5736 PPM.

A further sample of the fibers was treated in an aqueous hydrochloric acid solution having a concentration of 3.5% by weight and a temperature of 176° F. for 5 minutes, following which the sample was rinsed in deionized water at 176° F. for 3 minutes and dried. The sample as so treated was determined to have a total alkali and alkaline earth metal content of 1659 PPM.

A further sample of the fibers was treated in an aqueous hydrochloric acid solution having a concentration of 3.5% by weight and a temperature of 175° F. for 5 mintues, following which the sample was rinsed in deionized water at room temperature for approximately 10 minutes and dried. The sample as so treated was determined to have a total alkali and alkaline earth metal content of 2841 PPM.

A further sample of the fibers was treated in an aqueous sulfuric acid solution having a concentration of 2.0% by weight and a temperature of 176° F. for 5 minutes, following which the sample was rinsed in deionized water at 176° F. for 3 minutes and dried. The sample as so treated was determined to have a total alkali and alkaline earth metal content of 1386 PPM.

A further sample of the fibers was treated in an aqueous sulfuric acid solution having a concentration of 2% by weight and a temperature of 176° F. for 5 minutes, following which the sample was rinsed in deionized water at room temperature for approximately 10 minutes and dried. The sample was determined to have a total alkali and alkaline earth metal content of 2284 PPM.

EXAMPLE 4

A sample of Monsanto MON-B16 fibers was treated in an aqueous hydrochloric acid solution having a concentration of 35% by weight and a temperature of 185° F. for 30 minutes, following which the sample was rinsed in deionized water at 203° F. for 15 minutes and dried. The sample as so treated was tested and determined to have a sodium content of 19 PPM, a potassium content of 4 PPM, and a calcium content of 12 PPM.

A further sample of the fibers was treated in an aqueous 0.4 M hydrochloric acid solution at a temperature of 203° F. for 10 minutes, following which the sample was rinsed in deionized water at 203° F. for 15 minutes and dried. The sample as so treated was determined to have a sodium content of 17 PPM, a potassium content of 5 PPM and a calcium content of 7 PPM.

EXAMPLE 5

A sample of DuPont DUP-T43 fibers was treated in an aqueous hydrochloric acid solution having a concentration of 35% by weight and a temperature of 185° F. for 30 minutes, following which the sample was rinsed in deionized water at 203° F. for 15 minutes and dried. The sample as so treated was determined to have a sodium content of 57 PPM, a potassium content of 7 PPM and a calcium content of 32 PPM.

A further sample of the fibers was treated in an aqueous 0.4 M hydrochloric acid solution at 203° F. for 10 minutes, following which the sample was rinsed in deionized water at 203° F. for 15 minutes and dried. The sample as so treated was determined to have a sodium content of 43 PPM, a potassium content of 5 PPM and a calcium content of 28 PPM.

EXAMPLE 6

A quantity of commercially available PAN based fibers which had been oxidized and which were of at least 85 mol % acrylonitrile was determined to have a sodium content of 4750 PPM, a potassium content of 1000 PPM, and a calcium content of 15 PPM, with the total of the three being 5765 PPM. A sample of the fibers was then treated in an aqueous hydrochloric acid solution having a concentration of 10% by weight and mixed with a 0.2% by weight aqueous solution of Triton X-100 non-ionic detergent. The hydrochloric acid and detergent solution was heated to 180° F. and washing was carried out for 1 hour. Next the sample was rinsed in deionized water at 160° F., and then dried in an oven. The sample as so treated was determined to have a sodium content of 23 PPM, a potassium content of 6 PPM and a calcium content of 4 PPM, with the total of the three being 33 PPM.

EXAMPLE 7

A further quantity of the fibers used in Example 6 was divided into five samples. Sample No. 1 was washed in deionized water at 180° F. for 1 hour and then dried. Sample No. 2 was treated in an aqueous formic acid solution having a concentration of 10% by weight and a temperature of 180° F. for 1 hour, following which the sample was rinsed in deionized water at 160° F. and dried. Sample No. 3 was treated in an aqueous hydrobromic acid solution having a concentration of 10% by weight and a temperature of 180° F. for 1 hour, following which the sample was rinsed in deionized water at 160° F. and dried. Sample No. 4 was treated in an aqueous hydrochloric acid solution having a concentration of 10% by weight and a temperature of 180° F. for 10 minutes, following which the sample was rinsed in deionized water at 160° F. and dried. Sample No.5 was treated in an aqueous hydrochloric acid solution having a concentration of 10% by weight and a temperature of 180° F. for 30 minutes, following which the sample was rinsed in deionized water at 160° F. and dried. The five different samples as so treated were determined to contained the following impurities:

| Sample No. | Sodium (PPM) | Potassium (PPM) | Calcium (PPM) | Magnesium (PPM) | Total (PPM) |
|---|---|---|---|---|---|
| 1 | 3125 | 575 | 10 | 3 | 3713 |
| 2 | 3 | 3 | 3 | 1 | 10 |
| 3 | 1 | 3 | 3 | nil | 7 |
| 4 | 2 | 2 | 3 | nil | 7 |
| 5 | 2 | 2 | 3 | nil | 7 |

EXAMPLE 8

A quantity of commercially available PAN based fibers of at least 85 mol % acrylonitrile which had been oxidized and woven into a fabric was divided into a number of samples.

A first group of the oxidized fabric samples was treated in aqueous hydrochloric acid solutions having varying concentrations and a temperature of 160° F. for 30 minutes, following which the samples were rinsed in deionized water at 198° F. for 25 minutes, and dried. The samples as so treated were tested for impurities with the following results:

| Impurities | Unpurified Fabric | 0.1% HCl | 0.5% HCl | 1.9% HCl | 2.5% HCl | 10% HCl |
|---|---|---|---|---|---|---|
| Sodium (PPM) | 4055 | 4 | 2 | 3 | 1 | 2 |
| Potassium (PPM) | 328 | 2 | 1 | 2 | 1 | 1 |
| Calcium (PPM) | 140 | 125 | 109 | 88 | 105 | 63 |
| Magnesium (PPM) | 88 | 82 | 83 | 70 | 76 | 56 |
| Lithium (PPM) | <1 | <1 | <1 | <1 | <1 | <1 |
| Total (PPM) | 4692 | 194 | 196 | 164 | 184 | 123 |
| % Purification | 0.0 | 95.9 | 95.8 | 96.5 | 96.1 | 97.4 |

A second group of the oxidized fabric samples was subjected to the same treatments as the first group, with the exception that an aqueous solution of Hyonic PE 100 non-ionic detergent having a concentration of 0.2% by weight was mixed with the aqueous acid solution. Following purification the samples were tested and the following results were observed:

| Impurities | Detergent Only | 0.1% HCl | 0.5% HCl | 1% HCl | 2.5% HCl | 10% HCl |
|---|---|---|---|---|---|---|
| Sodium (PPM) | 3031 | 8 | 11 | 3 | 7 | 1 |
| Potassium (PPM) | 370 | 2 | 1 | 5 | 6 | 1 |
| Calcium (PPM) | 176 | 100 | 93 | 80 | 75 | 48 |
| Magnesium (PPM) | 94 | 87 | 69 | 68 | 69 | 46 |
| Lithium (PPM) | <1 | <1 | <1 | <1 | <1 | <1 |
| Total (PPM) | 3672 | 198 | 175 | 157 | 158 | 97 |
| % Purification | 21.7 | 95.7 | 96.2 | 96.6 | 96.5 | 97.9 |

The fabric samples of a third group of the oxidized fibers were each treated in an aqueous hydrochloric acid solution having a concentration of 2.5% by weight and a temperature of 160° F. for 30 minutes, following which the samples were rinsed in deionized water at 190° F. for 25 minutes and then dried. In each case the aqueous acid solution was mixed with an aqueous solution of the Hyonic PE 100 non-ionic detergent having a different concentration by weight. Following purification, the samples were tested and produced the following results:

| Impurities | 0% Detergent | 0.5% Detergent | 0.1% Detergent | 0.2% Detergent | 2.5% Detergent |
|---|---|---|---|---|---|
| Sodium (PPM) | 1 | 1 | 34 | 7 | 4 |
| Potassium (PPM) | 1 | 5 | 12 | 6 | 1 |
| Calcium (PPM) | 105 | 46 | 80 | 75 | 85 |
| Magnesium (PPM) | 76 | 74 | 61 | 69 | 69 |
| Lithium (PPM) | <1 | <1 | <1 | <1 | <1 |
| Total (PPM) | 184 | 177 | 188 | 158 | 160 |
| % Purification | 96.0 | 96.1 | 95.9 | 96.5 | 96.5 |

EXAMPLE 9

A fabric woven from commercially available PAN based fibers of at least 85 mol % acrylonitrile which had been oxidized was divided into a plurality of samples.

A first group of the oxidized samples was purified with the first such sample being washed in deionized water only. The other samples were treated in aqueous hydrochloric acid solutions of varying concentration by weight having a temperature of 160° F. for 30 minutes, following which the samples were rinsed in deionized water at 198° F. for 25 minutes and then dried. The samples as so treated were tested and produced the following results:

| Impurities | Unpurified Fabric | $H_2O$ Only | 2.5% HCl | 5% HCl | 10% HCl |
|---|---|---|---|---|---|
| Sodium (PPM) | 1875 | 500 | 8 | 4 | 6 |
| Potassium (PPM) | 2 | 2 | 4 | 1 | 3 |
| Calcium (PPM) | 28 | 50 | 3 | 3 | 3 |
| Magnesium (PPM) | 225 | 75 | 34 | 18 | 20 |
| Lithium (PPM) | <1 | <1 | <1 | <1 | <1 |
| Total (PPM) | 2131 | 628 | 50 | 27 | 33 |

Two more of the oxidized fabric samples were then treated in an aqueous hydrochloric acid solution having a concentration of 5% by weight at 198° F., following which the samples were rinsed in deionized water at 198° F. for 25 minutes, and then dried. The first sample was treated in the acid solution for 30 minutes, while the second sample was treated in the acid solution for 2 hours. The samples as so treated were tested and produced the following results:

| | 30 minute treatment | 2 hour treatment |
|---|---|---|
| Sodium (PPM) | 5 | 13 |
| Potassium (PPM) | 11 | 4 |
| Calcium (PPM) | 3 | 3 |
| Magnesium (PPM) | 10 | 12 |
| Lithium (PPM) | <1 | <1 |
| Total (PPM) | 30 | 33 |

A third group of the oxidized fabric samples was then treated. The first such sample was washed in a 0.2% by weight aqueous solution of Hyonic PE 100 non-ionic detergent at 160° F. for 30 minutes, and was thereafter rinsed in deionized water at 198° F. for 25 minutes and dried. The remaining samples were treated in a mixture of aqueous hydrochloric acid solution and aqueous non-ionic detergent solution of 0.2% by weight concentration at 160° F. for 30 minutes, with the concentration by weight of the acid being varied. Thereafter, the samples were washed in deionized water at 198° F. for 25 minutes, and dried. Testing of the samples as so treated produced the following results:

| Impurities | Detergent | 2.5% HCl | 5% HCl | 10% HCl |
|---|---|---|---|---|
| Sodium (PPM) | 2363 | 3 | 2 | 1 |
| Potassium (PPM) | 23 | 3 | 5 | 1 |
| Calcium (PPM) | 26 | 4 | 4 | 3 |
| Magnesium (PPM) | 25 | 4 | 5 | 5 |
| Lithium (PPM) | <1 | 1 | 1 | 1 |
| Total (PPM) | 2438 | 14 | 17 | 11 |

Two more of the oxidized fabric samples were treated in a mixture of an aqueous hydrochloric acid solution having a concentration of 5% by weight and an aqueous solution of Hyonic PE 100 non-ionic detergent having a concentration of 0.2% by weight at a temperature of 198° F. For one sample the residence time was 30 minutes and for the second sample the residence time was 2 hours. Each sample was then rinsed in deionized water at 93° C. for 25 minutes, and then dried. The samples as so treated produced the following results:

| | 30 minute treatment | 2 hour treatment |
|---|---|---|
| Sodium (PPM) | 1 | 1 |
| Potassium (PPM) | 1 | 1 |
| Calcium (PPM) | 5 | 6 |
| Magnesium (PPM) | 4 | 2 |
| Lithium (PPM) | 1 | 1 |
| Total (PPM) | 12 | 11 |

The treating and rinsing steps in the processes of Examples 2–9 were carried out by placing each piece of carbonaceous material to be treated in a container for the required residence time with occasional agitation or stirring but without continuous movement of the material through the solution, or circulation or spraying of the solutions. In the examples set forth immediately hereafter, the processes were carried out by continuously pulling an unwinding roll of the fabric through a recirculating acid treatment tank and through a rinse tank in which the deionized water was sprayed onto the fabric upon entry into and while within the tank.

EXAMPLE 10

Commercially available PAN based fibers of at least 85 mol % acrylonitrile which had been oxidized and woven into a fabric were treated in a mixture of aqueous hydrochloric acid solution and Triton X-100 non-ionic detergent aqueous solution at 198° F. for 60 minutes. The acid solution had a concentration of 10–11% by weight, and the detergent solution had a concentration of 0.2% by weight. Following treatment, the fabric was rinsed in deionized water at 140° F. for 15 minutes, and then dried. The impurities present in the fabric before and after the purification treatment were measured as follows:

| Impurities | Before Purification | After Purification |
|---|---|---|
| Sodium (PPM) | 3720 | 1 |
| Potassium (PPM) | 341 | 1 |
| Calcium (PPM) | 100 | 9.5 |
| Magnesium (PPM) | 50 | 12 |
| Lithium (PPM) | 1 | 1 |
| Total (PPM) | 4212 | 24 |

The fabric as so purified was then fired in a nitrogen atmosphere at 1900° F. for 4 minutes, producing a weight loss of 46.1%, and the impurities were then measured as follows:

| | |
|---|---|
| Sodium | 12 PPM |
| Potassium | 6 PPM |
| Calcium | 17 PPM |
| Magnesium | 20 PPM |
| Lithium | 1 PPM |

-continued

| | |
|---|---|
| Total | 56 PPM |

EXAMPLE 11

Commercially available PAN based fibers of at least 80 mol % acrylonitrile which had been oxidized were woven into a plurality of different fabrics. Each fabric was then treated in an aqueous hydrochloric acid solution having a concentration of 10–11% by weight and mixed with an aqueous solution of Triton X-100 non-ionic detergent having a concentration of 0.2% by weight at a temperature of 180° F. for 30 minutes, then rinsed in deionized water at 140° F. for 8 minutes, then dried. At this point the different fabrics were tested and determined to have a total alkali and alkaline earth metal content which ranged from 11 PPM for the purest sample to 27 PPM for the least pure sample. The fabrics were then carbonized by heating to a temperature of 1742–2462° F. for several minutes. Following carbonization the various fabrics were tested and determined to have a total alkali and alkaline earth metal content which ranged from a low of 38 PPM to a high of 125 PPM. The fabrics experienced a substantial weight loss during carbonization, and the total alkali and alkaline earth metal impurity can be expected to increase from the figures obtained prior to carbonization. However, the readings which were 125 PPM or slightly less are thought to be due to contamination of the fabric from the carbonization furnace.

EXAMPLE 12

To learn the effects of the temperature of the aqueous acid solution on purity, samples of commercially available oxidized PAN based cloth were obtained. The samples were determined to have total impurities of 4789 PPM. The samples were then treated in a 5% solution of HCl at different temperatures for 35 minutes. The acid temperature was raised in 25° F. increments from 75° F. to 200° F. Following treatment, each sample was rinsed in deionized water at 150° F. for 9 minutes and then dried and tested for purity. Using samples of the same cloth the experiment was repeated as a second run at a later date. The relationship between acid temperature and the purity of the two different runs is shown by the following:

| Acid Temperature | First Run | Second Run |
|---|---|---|
| 75° F. | 87 PPM | 61 PPM |
| 100° F. | 67 PPM | 18.3 PPM |
| 125° F. | 16.6 PPM | 15.0 PPM |
| 150° F. | 16.0 PPM | 14.7 PPM |
| 175° F. | 35.6 PPM | 16.0 PPM |
| 200° F. | 20.1 PPM | 14.0 PPM |

The value of 35.6 PPM in the first run is thought to be attributable to normal test variations. In any event these tests confirmed the indication provided by the tests that the purity levels are too high or at least inconsistent at acid temperatures which are not at least about 100° F. or higher.

EXAMPLE 13

To learn the effects of solvent temperature on the process and its interrelationship with acid temperature, the tests described in Example 12 were repeated for four different values of acid temperature using more samples of the material used in Example 12. However, at each acid temperature, the solvent (deionized water) temperature was changed in increments of 25° F. from 75° F. to 200° F. The concentration of the aqueous acid solution remained at 5% and the residence time at 35 minutes. The residence time of the rinse in deionized water remained at 9 minutes. The results are as follows:

| Rinse Temperature | Acid Temperature 75° F. | 100° F. | 125° F. | 150° F. |
|---|---|---|---|---|
| 75° F. | 79.7 PPM | 133.0 PPM | 24.3 PPM | 17.0 PPM |
| 100° F. | 59.7 PPM | 53.0 PPM | 23.3 PPM | 15.7 PPM |
| 125° F. | 66.7 PPM | 62.3 PPM | 24.0 PPM | 17.7 PPM |
| 150° F. | 56.3 PPM | 48.7 PPM | 19.7 PPM | 19.3 PPM |
| 175° F. | 40.3 PPM | 70.7 PPM | 12.3 PPM | 15.3 PPM |
| 200° F. | 32.7 PPM | 20.7 PPM | 13.0 PPM | 14.0 PPM |

It will be seen that as a general proposition, for a given acid temperature the purity improved with increasing rinse water temperature. For rinse temperatures at or close to room temperature (75° F.), relatively high acid temperatures of about 150° F. or greater were required. Since increasing acid temperatures pose additional equipment problems, especially in a continuous process, the best compromise is to select an optimum value of acid temperature (125° F.+) and then select a rinse temperature which will produce acceptable results. In the present example this requires that the rinse temperature be at least about 150° F.

EXAMPLE 14

The data generated in Example 13 showed that when both the aqueous acid solution and the rinse water were at room temperature (75° F.) the purity produced was 79.7 PPM. It was decided to determine if acceptable purity could be achieved by increasing the acid concentration or the acid and water residence times or both. With the acid concentration held at 5% and the acid and rinse water at room temperature (75° F.) the residence times were doubled, tripled and then quadrupled. Then the acid concentration was raised to 15% and the process was repeated. The results are as follows:

| Acid Residence Time | Rinse Water Residence Time | Acid Concentration 5% | 15% |
|---|---|---|---|
| 70 min. | 18 min. | 102 PPM | 39.3 PPM |
| 105 min. | 27 min. | 59.3 PPM | 22 PPM |
| 140 min. | 36 min. | 65 PPM | 15 PPM |

It will be seen that although acceptable purity levels can be achieved at room temperature if the acid concentration is great enough and the residence times long enough, the difference in the residence times when compared with the same process at elevated temperatures is one of several orders of magnitude. Thus, while an acid residence time of 35 minutes and a rinse residence time of 9 minutes is commercially feasible for many applications, residence times which are 3 or 4 times greater are not feasible for many applications. The practical result is that the acid temperature must be greater than about 100° F. and the rinse water temperature is preferably elevated above room temperature to at least about 150° F. or greater.

EXAMPLE 15

To learn the effects of acid concentration on material purity, it was decided to vary the concentration while keeping all other parameters constant. The procedure was then repeated for longer acid residence times to see what the effect would be. The commercially obtained oxidized PAN used in this series of experiments had an average starting purity of 1874 PPM. The temperature of the aqueous HCl solution was maintained at 125° F. The deionized rinse water was maintained at 150° F. and the rinse residence time was 9 minutes. The results are as follows:

| Acid Concentration | Acid Residence Time 15 min. | 30 min. | 60 min. | 120 min. |
|---|---|---|---|---|
| 0.5% | 110.3 PPM | 91.0 PPM | 97.0 PPM | 39.3 PPM |
| 1.0% | 72.3 PPM | 63.3 PPM | 55.0 PPM | 21.3 PPM |
| 3.0% | 67.0 PPM | 32.3 PPM | 130.3 PPM | 15.0 PPM |
| 5.0% | 36.7 PPM | 19.7 PPM | 19.7 PPM | 16.0 PPM |
| 15.0% | 17.0 PPM | 11.3 PPM | 15.7 PPM | 13.0 PPM |

It will be seen that a concentration of at least about 5% is required to produce a purity level of about 20 PPM or less at an acid residence time of 30 minutes or less. Concentrations as low as 1% or less will work but the required residence time is so long as to make the process commercially impractical. At higher concentrations such as 15% the results are uniformly good, even at residence times as low as 15 minutes. In implementing such a process commercially a compromise is required between purity and reduced residence time on the one hand and the additional equipment problem posed by a higher acid concentration on the other. Also, as previously noted, HCl concentrations as high as 35% have been found to work, although the results have often been found to deteriorate at concentrations very much above 15% because of the excessive number of ions present.

While the invention has been described with reference to preferred embodiments thereof, it will be understood by those skilled in the art that the foregoing and other changes in form and details may be made therein without departing from the spirit and scope of the invention.

What is claimed is:

1. A method of treating oxidized polyacrylonitrile material to reduce alkali and alkaline earth metal impurities therein to a total content of no greater than 50 parts per million essentially uncarbonized form comprising the steps of contacting oxidized polyacrylonitrile material which is essentially uncarbonized with an aqueous acid solution of at least 0.5% and not substantially greater than 35% concentration by weight for 5–120 minutes, the solution being maintained at a temperature greater than 100° F., removing the aqueous acid solution from the material and rinsing the material with a solvent which is substantially free of alkali and alkaline earth metal ions, the rinsing taking place for 5–30 minutes.

2. The method set forth in claim 1, wherein the solvent is maintained at a temperature of at least about 150° F.

3. The method set forth in claim 1, further including the step of drying the material following rinsing thereof to remove substantially all solvent therefrom.

4. The method set forth in claim 2, further including the step of carbonizing the material in an inert atmosphere at 1500° F. up to a temperature at which the material begins to graphitize, following drying thereof.

5. The method set forth in claim 1, wherein the aqueous acid solution comprises an aqueous solution of hydrochloric acid having a concentration of 3–15% by weight, the step of contacting the material with the solution takes place for at least 15 minutes and the solution is maintained at a temperature of at least 125° F.

6. The method set forth in claim 1, wherein the step of contacting the material with an aqueous acid solution includes providing substantially continuous motion between the material and the aqueous acid solution, and the step of rinsing the material with a solvent includes providing substantially continuous motion between the material and the solvent.

7. The method set forth in claim 1, wherein the polyacrylonitrile material is in the form of a length of oxidized fabric and the step of contacting the material with an aqueous acid solution includes providing a solution container in which the aqueous acid solution is contained and advancing the length of fabric through the solution container and the aqueous acid solution contained therein at a substantially constant speed.

8. The method set forth in claim 7, wherein the step of rinsing the material with a solvent includes providing a solvent container, advancing the length of fabric through the solvent container at a substantially constant speed and spraying the solvent onto the length of fabric within the solvent container.

9. The method set forth in claim 1, wherein the aqueous acid solution has a concentration by weight of 0.5–35%.

10. The method set forth in claim 1, wherein the deionized solvent consists of deionized water.

* * * * *

UNITED STATES PATENT AND TRADEMARK OFFICE

CERTIFICATE OF CORRECTION

PATENT NO. : 4,388,289

DATED : June 14, 1983

INVENTOR(S) : Gary D. Shepherd et al

It is certified that error appears in the above-identified patent and that said Letters Patent are hereby corrected as shown below:

Column 2, line 12, after "a" and before "sufficient", "temperaature" should read --temperature--. Column 9, line 55, after "with" and before "samples", "washed" should read --unwashed--. Column 11, line 16, after "of" and before "for", "175° F." should read --176° F.--. Column 12, line 46, after "to" and before "the", "contained" should read --contain--.

Signed and Sealed this

*Twentieth* Day of *September 1983*

[SEAL]

*Attest:*

GERALD J. MOSSINGHOFF

*Attesting Officer*

*Commissioner of Patents and Trademarks*